US006752386B1

(12) United States Patent
Bundy

(10) Patent No.: US 6,752,386 B1
(45) Date of Patent: Jun. 22, 2004

(54) FENCE WITH SLIDING LOCK BAR

(76) Inventor: Donald Eugene Bundy, 16521 S. Hickory, Sapulpa, OK (US) 74066

( * ) Notice: Subject to any disclaimer, the term of this patent is extended or adjusted under 35 U.S.C. 154(b) by 0 days.

(21) Appl. No.: 10/436,711

(22) Filed: May 13, 2003

(51) Int. Cl.[7] ..... E04H 17/16
(52) U.S. Cl. ..... 256/65.12; 256/22
(58) Field of Search ..... 256/22, 65.12, 256/59, 65.01, 65.02, 21, 19

(56) References Cited

U.S. PATENT DOCUMENTS 4,723,760 A * 2/1988 O'Sullivan ..... 256/22
5,443,244 A * 8/1995 Gibbs ..... 256/22
5,454,548 A 10/1995 Moore
5,882,001 A * 3/1999 Reinbold ..... 256/22
6,254,064 B1 * 7/2001 Gibbs ..... 256/22

* cited by examiner

*Primary Examiner*—John R. Cottingham
(74) *Attorney, Agent, or Firm*—Molly D. McKay

(57) ABSTRACT

A picket and rail fence and method for constructing the fence using a plurality of pickets with side indentions at locations where the pickets will attach to the rails, rails with open bottoms to allow for flexibility in the angle of incidence between the rails and the pickets, and sliding lock bars with ridges that slide into the rails between the side of the rail and the pickets. The ridges engage the indentions in the pickets to movably secure the pickets to the rails. The rails are provided with upwardly oriented bottom lips along their length that serve to prevent the pickets from moving in a vertical plane perpendicular to the longitudinal axis of the rails and serve to retain the sliding lock bars within the rails.

5 Claims, 3 Drawing Sheets

FENCE WITH SLIDING LOCK BAR

BACKGROUND OF THE INVENTION

1. Field of the Invention

The present invention relates to a fence and method for making same. The fence is a rail and picket fence with a rail that is open of the bottom side to allow a greater amount of flexibility of the angle between the rail and pickets. The rails and pickets are held together with a sliding lock bar with a single ridge that engages an indention provided in the pickets specifically for the purpose of securing them together while still allowing flexibility in the angle of intersection between the rail and pickets.

2. Description of the Related Art

Current rail and picket fences are limited in the angle of intersection of the rails and pickets because they employ rails that are constructed of tubular stock and that tubular stock is then provided with openings in both its top surface and its bottom surface to receive each picket. Thus, because there are two openings in each rail associated with each picket, the size of those openings limits how large the deviation from a perpendicular orientation can be created between the rails and the vertical pickets when constructing the fence.

Another problem with current fences of this type is that normally each picket must be individually secured by welding or other means to each rail, thereby causing the construction of these picket and rail fences to be extremely labor intensive and expensive, thereby limiting the use and market for these types of fences.

The present invention addresses both of these problems by providing a fence that is constructed with rails that are open of the bottom side to allow a greater amount of flexibility of the angle between the rail and pickets. The rails are provided with upwardly oriented bottom lips that prevent the pickets from moving out of a vertical plane that coincides with the longitudinal axis of the rails. These upwardly oriented bottom lips retain a sliding lock bar that inserts from the end of the rail after the pickets have been inserted into picket openings provided in the top surface of the rail. Each picket is provided with an indention in its side so that when the sliding lock bar is inserted into the rail, a single ridge provided along the length of the sliding lock bar engages the indentions in each of the pickets, thereby moveably securing the pickets to the rail. The sliding lock bar is held in place internally within the rail by one upwardly orient bottom lip, an interior side wall of the rail adjacent to that bottom lip, and interior top wall of the rail, and the notched pickets. Because each picket is provided with only one notch per rail and because the sliding lock bar is provided with only a single ridge to engage the associated notches in the pickets, the pickets are free to move in a plane that coincides with or includes the longitudinal axis of the rail, with the movement of the pickets limited only by the top opening in the rails and the ability of the sliding lock bars to move within their associated rails. This flexibility in the angle of intersection of the bars and rails is possible because the rails do not have a bottom surface and associated bottom picket openings in that bottom surface that can severely limit the movement of the pickets in a plane that coincides with the longitudinal axis of the rails.

Because of the flexibility of the angle of intersection, the present invention can be employed in uneven and hilly terrain without any modifications to the fence components. Because the fence rails and pickets are secured together with sliding lock bars, creating a fence with the present invention is fast and easy and can be done by unskilled workmen or even a homeowner.

Also, because the components, i.e. the rails, pickets, and sliding lock bars, are prefabricated in the shop and do not require customization at the installation site, the components are relatively inexpensive to manufacture and can be sold at lumber yards and home improvement stores for installation by the general consumer, thus greatly increasing the market for these types of fences.

Because of the way the sliding lock bar secures the pickets and rails together as a unit, fences constructed according to the present invention are as strong or stronger than currently available custom built picket and rail fences. Also fences of the present invention are attractive, being almost indistinguishable in appearance from custom built picket and rail fences that cost much more.

An added benefit from this invention is that, because the pickets and rails are secured together without welding, they can be finished, such as by powder coating or plating, in the shop prior to shipment and do not require touch up painting after the fence is constructed. Another benefit from this invention is that the open bottom of the rails allows moisture to escape more easily from the rails and therefore results in less damage to the rails over time.

SUMMARY OF THE INVENTION

The present invention is a method for constructing a picket and rail fence using pickets with side indentions, rails with open bottoms, and sliding lock bars that secure the pickets to the rails. After pickets have been inserted through each picket opening provided in the top of each rail, a sliding lock bar is inserted into the rail so that the bar is positioned between the side of the pickets and the rail. As the sliding lock bar is thus inserted in the rail, a single ridge provided along the length of each sliding lock bar engages the indentations in the pickets to thereby secure the pickets to the rail. The rails are provided with upwardly oriented bottom lips along their length that serve to prevent the pickets from moving in a vertical plane perpendicular to the longitudinal axis of the rails and serve to retain the sliding lock bars within the rails.

DETAILED DESCRIPTION OF THE PREFERRED EMBODIMENT

THE INVENTION

Figure 1:
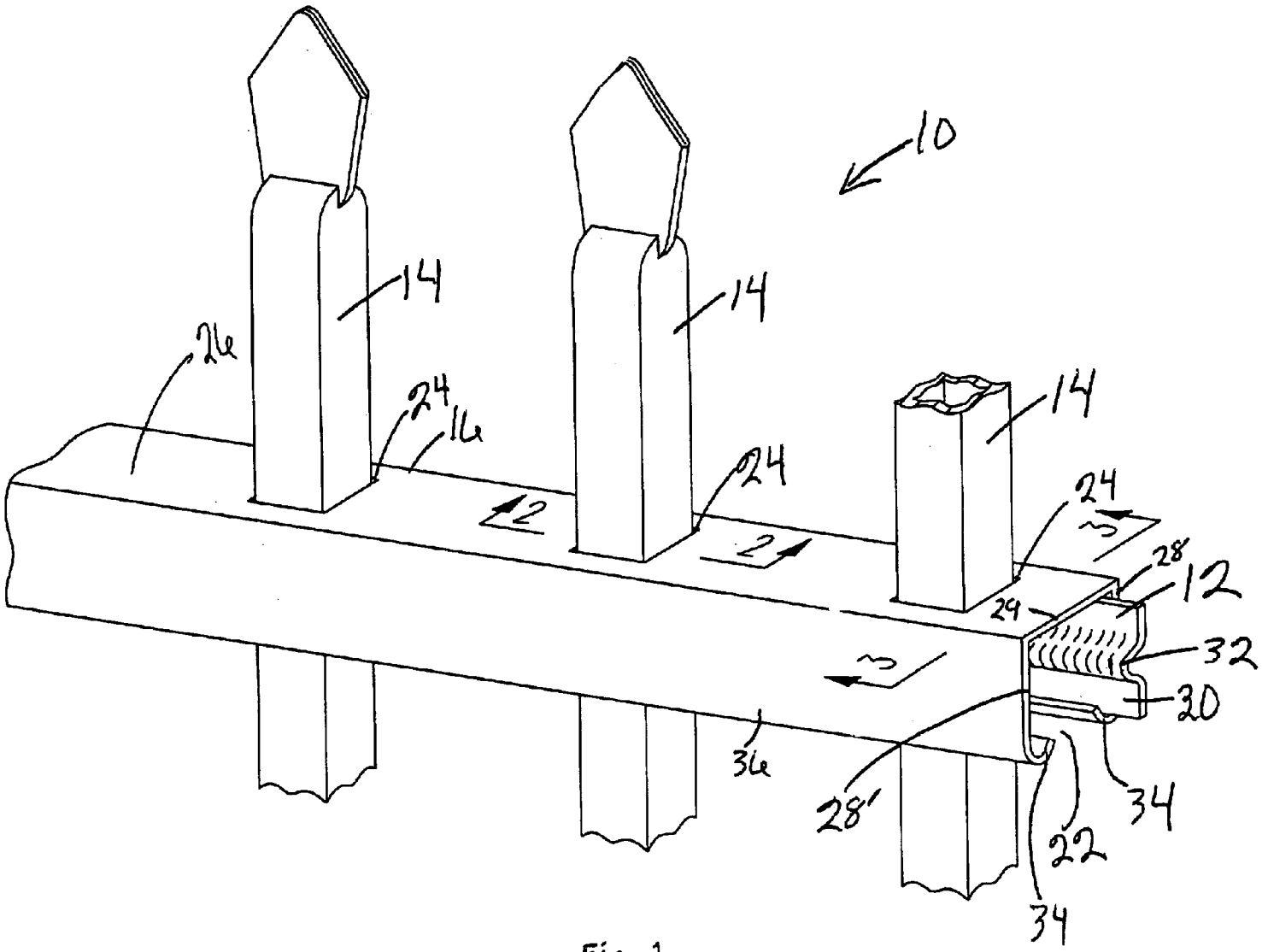
FIG. 1 is a perspective view of a fence constructed in accordance with a preferred embodiment of the present invention.

Referring now to the drawings and initially to FIG. 1, there is illustrated a fence 10 with sliding lock bar 12 constructed in accordance with a preferred embodiment and method of the present invention. The fence 10 is constructed of vertical pickets 14 and horizontal rails 16 with sliding lock bars 12 securing the pickets 14 and rails 16 together. The fence 10 is constructed with two or more rails 16 and with a plurality of pickets 14.

The pickets 14 are prefabricated with indentions 18 provided in one side 20 of the pickets 14 at locations on the pickets 14 where the rails 16 will be attached. The rails 16 are each provided with an open bottom 22 and with equally spaced apart picket openings 24 in a top 26 of the rail 16 for receiving the pickets 14.

To construct the fence 10, the pickets 14 are inserted into the picket openings 24 for each of the rails 16 that are desired in the completed fence 10. Although not illustrated, two or more rails 16 may be used to construct a fence 10, so that the fence 10 is provided with a top rail 16 and a bottom rail 16 and possibly additional rails 16 located between the top rail 16 and the bottom rail 16.

Figure 3:
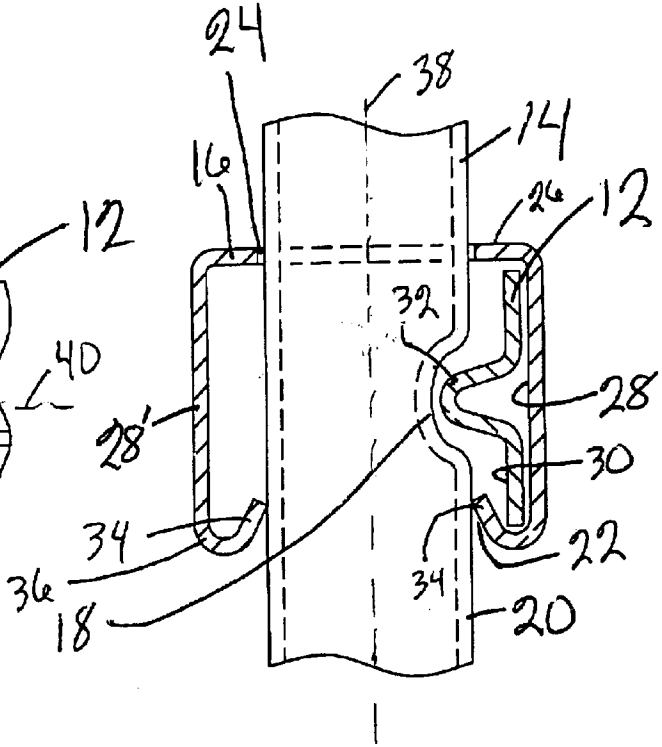
FIG. 3 is a cross sectional view of a single picket and rail of the fence taken along line 3—3 of FIG. 1.
Figure 2:
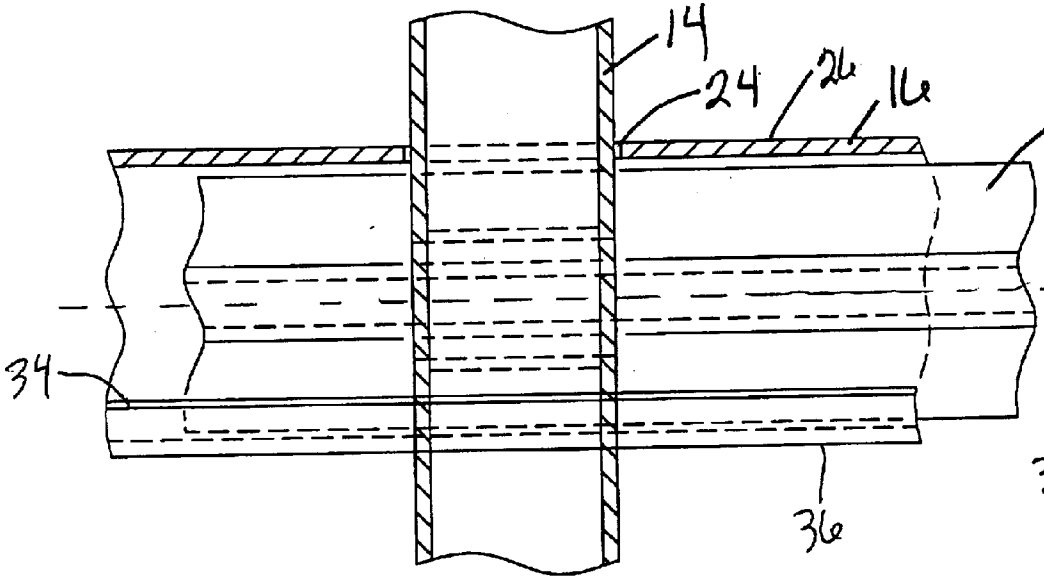
FIG. 2 is a cross sectional view of a single picket and rail on the fence taken along line 2—2 of FIG. 1.

As illustrated in FIGS. 2 and 3, after the pickets 14 have been inserted through the picket openings 24 so that the side 20 in which the indentations 18 are provided all facing toward one side 28 of the rail 16, a sliding lock bar 12 is inserted into the rail 16. The sliding lock bar 12 is inserted into the rail 16 from one of the ends 29 of the rail 16 so that a side 30 of the bar 12 that is provided with a longitudinal ridge 32 faces the pickets 14 and so that the bar 12 is positioned between the side 20 of the pickets 14 and the side 28 of the rail 16. As the sliding lock bar 12 is thus inserted in the rail 16, the ridge 32 of the bar 12 is received within the indentations 18 in the pickets 14, thereby securing the pickets 14 to the rail 16.

Each rail 16 is provided with an upwardly oriented bottom lip 34 on the bottom 36 of each of its sides 28 and 28' so that the bottom lips 34 extend along the length 38 of the rails 16. The bottom lips 34 serve to prevent the pickets 14 from moving in a vertical plane 38 perpendicular to the longitudinal axis 40 of the rails 16 and also serve, in conjunction with the tops 26 of the rails 16, to retain the sliding lock bars 12 within the rails 16 by preventing the sliding lock bars 12 from falling out of the rails 16 via the open bottoms 22 of the rails 16.

Figure 5:
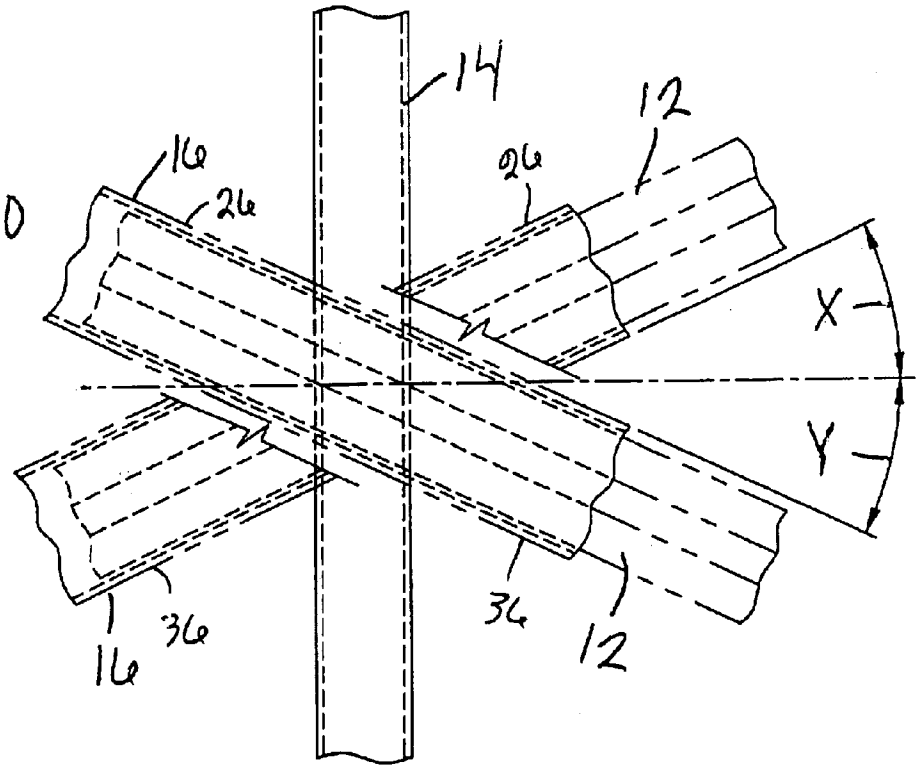
FIG. 5 is a drawing of the rail and picket of FIG. 4 showing the flexibility in the angle of incidence between the rail and picket.
Figure 4:
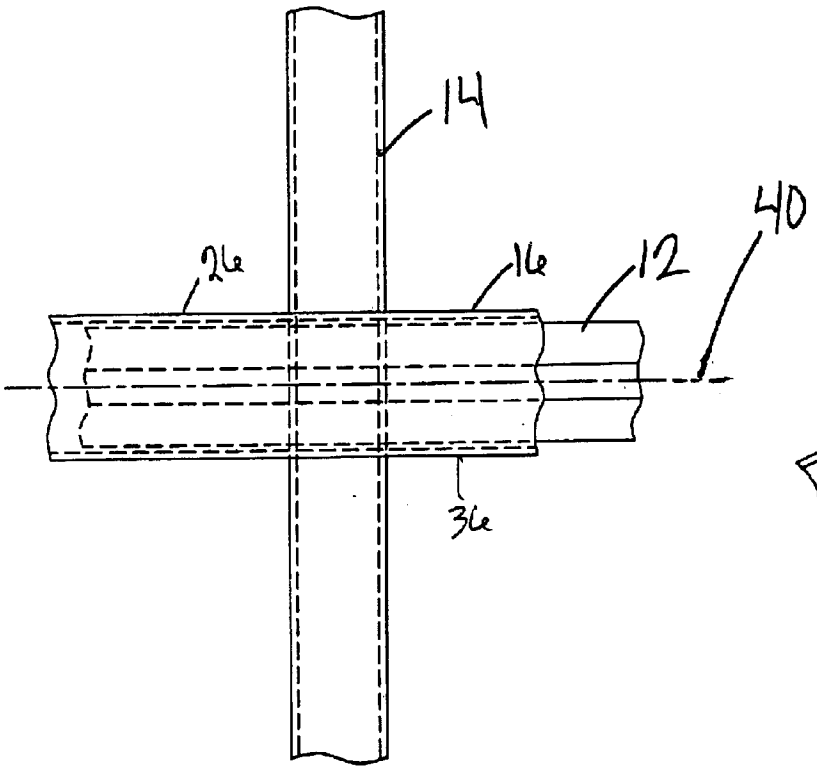
FIG. 4 is a drawing similar to FIG. 2, showing the rail and picket in perpendicular orientation relative to each other.

FIGS. 4 and 5 illustrate one of the main advantages of the present fence 10. The open bottoms 22 of the rails 16 allow the rails and posts to secure to each other perpendicularly, as shown in FIG. 4, but also allow the fence 10 to have flexible angles of incidence when needed for building fence on uneven terrain. These flexible angles of incidence are illustrated in FIG. 5 by angles X and Y.

Although not illustrated, to complete construction of the post and rail fence 10, each end 29 of the rails 16 is secured to a fence post (not illustrated) according to common fence construction practice to create the post and rail fence 10. The rails 16 may be secured to the fence posts employing brackets or by any other suitable means.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A picket and rail fence comprising:

rails for a picket and rail fence, each rail provided with an open bottom, an upwardly extending lip extending into the open bottom of each rail from a bottom of each side of the rail, and a top of the rail provided with equally spaced apart picket openings extending through the rail along the entire length of the rail, pickets for a picket and rail fence, each picket provided with indentations along one side of the picket at locations where the picket is to attach to rails, each picket inserted into the picket openings in the rails so that each picket extends through at least two rails and so that the indented sides of all pickets face toward one side of its associated rail, sliding lock bars for movably securing together the pickets and rails for a picket and rail fence, each bar provided with one ridge provided along the length of the bar, a sliding lock bar inserted through each rail so that the ridge is received in the indentations of the pickets to movable secure the pickets to the rails, and the sliding lock bar captured between the indented side of the pickets and one side of the rail and between the top of the rail and one of the upwardly extending lips of the rail to secure the sliding lock bar within the rail.

2. A picket and rail fence according to claim 1 wherein the ridge is provided centrally along the length of each said sliding lock bar.

3. A picket and rail fence according to claim 1 further comprising:

securing the ends of the rails to fence posts to construct a picket and rail fence.

4. A method for construction a picket and rail fence comprising the following steps:

a. forming a sliding lock bar with one ridge provided therein; indenting pickets along one side of the pickets at locations where the pickets are to attach to rails to form a picket and rail fence; and forming rails so that each rail is provided with an open bottom, an upwardly extending lip extending into the open bottom from a bottom of each side of the rail, and a top that is provided with equally spaced apart picket openings extending through the rail along the entire length of the rail, b. inserting the pickets into each of the picket openings in the rails so that each picket extends through at least two rails and so that the indented sides of all pickets face toward one side of its associated rail, and c. inserting a sliding lock bar through each rail so that the ridge is received in the indentations of the pickets and the sliding lock bar is captured between the indented side of the pickets and one side of the rail and between the top of the rail and one of the upwardly extending lips of the rail.

5. A method for construction a picket and rail fence according to claim 4 further comprising the following steps:

d. securing each end of the rails to a fence post to construct a picket and rail fence.

* * * * *